US007506723B2

(12) United States Patent
Hoerr et al.

(10) Patent No.: US 7,506,723 B2
(45) Date of Patent: Mar. 24, 2009

(54) MUFFLER FOR AN EXHAUST GAS SYSTEM

(75) Inventors: Micha Hoerr, Altbach (DE); Michael Pommerer, Uhingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 225 days.

(21) Appl. No.: 11/513,820

(22) Filed: Aug. 31, 2006

(65) Prior Publication Data

US 2007/0045043 A1 Mar. 1, 2007

(30) Foreign Application Priority Data

Sep. 1, 2005 (DE) ..... 10 2005 041 692

(51) Int. Cl.
*F01N 1/02* (2006.01)
*F01N 1/08* (2006.01)

(52) U.S. Cl. ..... 181/250; 181/253; 181/254; 181/272; 181/273; 181/275

(58) Field of Classification Search ..... 181/250, 181/251, 253, 254, 266, 268, 272, 273, 275, 181/276, 237, 238, 239, 241, 257; 60/312, 60/322

See application file for complete search history.

(56) References Cited

U.S. PATENT DOCUMENTS 2,625,234 A * 1/1953 Fina ..... 181/239
4,840,030 A * 6/1989 Ikeda et al. ..... 60/324
4,866,933 A * 9/1989 Kao ..... 60/312
4,901,528 A 2/1990 Saigo et al.
4,913,260 A * 4/1990 Fallon ..... 181/254
5,014,817 A * 5/1991 Takato et al. ..... 181/254
5,097,664 A * 3/1992 Nagatomo et al. ..... 60/273
5,301,503 A * 4/1994 Martinelli ..... 60/288
5,614,699 A * 3/1997 Yashiro et al. ..... 181/254
5,692,374 A * 12/1997 Seki et al. ..... 60/312
5,708,237 A * 1/1998 Maeda et al. ..... 181/254
5,723,827 A * 3/1998 Sasaki et al. ..... 181/237
5,723,829 A * 3/1998 Inomata et al. ..... 181/254
5,984,045 A * 11/1999 Maeda et al. ..... 181/254
6,173,808 B1 * 1/2001 Maeda et al. ..... 181/254
6,554,099 B2 * 4/2003 Uegane ..... 181/275
6,598,390 B2 * 7/2003 Chang ..... 60/323
6,755,279 B2 * 6/2004 Kaneko et al. ..... 181/232

(Continued)

FOREIGN PATENT DOCUMENTS

DE 3837677 A1 * 6/1989

(Continued)

*Primary Examiner*—Edgardo San Martin
(74) *Attorney, Agent, or Firm*—Howard IP Law Group, PC

(57) ABSTRACT

The invention relates to a muffler for an exhaust system of an internal combustion engine, consisting a housing having at least one exhaust inlet and at least one exhaust outlet and having at least two pipes at the inlet end or at the outlet end, at least one of which is switchable by a control device at least between an open state and a closed state and is acoustically coupled to a silencer system, such that the silencer system is active when the switchable pipe is opened as well as when it is closed and has a different damping characteristic when the switchable pipe is opened than when the switchable pipe is closed.

25 Claims, 3 Drawing Sheets

U.S. PATENT DOCUMENTS

| | | | | |
|---|---|---|---|---|
| 7,337,609 | B2 * | 3/2008 | Mahnken et al. | 60/297 |
| 2002/0005318 | A1 * | 1/2002 | Schumacher et al. | 181/237 |
| 2006/0162995 | A1 * | 7/2006 | Schorn et al. | 181/237 |

FOREIGN PATENT DOCUMENTS

| | | | |
|---|---|---|---|
| DE | 3807948 | A1 * | 9/1989 |
| DE | 19743446 | | 12/1998 |
| JP | 1110821 | | 4/1989 |
| JP | 03185209 | A * | 8/1991 |
| JP | 04012145 | A * | 1/1992 |
| JP | 29228819 | | 9/1997 |

* cited by examiner

MUFFLER FOR AN EXHAUST GAS SYSTEM

This application claims foreign priority of German Patent Application No. DE 10 2005 041 692.6, filed Sep. 1, 2005 in Germany, which application is incorporated herein by reference in its entirety.

FIELD OF THE INVENTION

The present invention relates generally to a muffler for an exhaust system of an internal combustion engine, in particular in a motor vehicle.

BACKGROUND OF THE INVENTION

A muffler generally includes a housing having at least one exhaust inlet and at least one exhaust outlet. Pipes may protrude into the housing on the inlet end and on the outlet end, and it is essentially possible to provide at least two pipes leading in parallel into the housing and/or out of the housing on the inlet end or the outlet end. In the case of mufflers, generally the problem is that gas flows against a flow resistance through the muffler, thus creating an increase in pressure in the exhaust system upstream from the muffler. This increase in pressure can have a considerable negative effect on the performance and efficiency of the internal combustion engine in certain operating states. It is therefore fundamentally possible to open and close at least one of the parallel pipes by means of a corresponding control device as needed. The switchable pipe is closed at low rotational speeds and/or at a low load of the internal combustion engine, whereas the pipe is opened at a higher rotational speed and/or at a higher load. The flow resistance of the muffler can be greatly reduced by adding-on the switchable pipe as described here. However, it has been found that this adding-on operation may be associated with additional noise emission into the environment because the silencing effect of the muffler is fundamentally optimized with regard to operating states having a low exhaust flow.

It is known (for example, German Patent DE 197 43 446 A1) that the exhaust system of an internal combustion engine can be designed with two flows, i.e., with two separate exhaust lines through which flow can pass in parallel, in at least one section. Each of these exhaust lines then has its own muffler. The two mufflers have different damping characteristics, i.e., they are tailored for different frequencies or frequency ranges. In addition, one of the exhaust lines may be opened and closed by means of a control valve. In the case of a low exhaust flow, the switchable exhaust line is blocked so that only the one muffler has exhaust flowing through it. When there is a high exhaust flow, the switchable exhaust line is opened so that exhaust passes through both mufflers.

SUMMARY OF THE INVENTION

The present invention provides an embodiment of a muffler which has an improved silencing effect, and which is inexpensive to manufacture.

The present invention is based on the general idea of acoustically coupling a switchable pipe of the muffler to a damping system in such a way that, on the one hand, the damping system is active when the pipe is opened and also when it is closed, i.e., it manifests its respective silencing effect in both cases, and on the other hand, it has a different damping characteristic when the pipe is opened than when it is closed. Due to this design, the switchable pipe forms a component of an effective damping system even in the closed state, changing its damping characteristics when the pipe is opened but remaining active. It is especially advantageous that the flow resistance of the muffler can be controlled with the help of a control device on the one hand while on the other hand the damping characteristics of the muffler can be varied. It is also especially advantageous that the damping system that is connected to the switchable pipe can be designed so that in both switch states, the interfering frequencies and/or the most interfering frequency ranges are suppressed.

In a preferred embodiment, the damping system may have a volume that is acoustically coupled to the at least one switchable pipe, i.e., is available in addition to the volume of the switchable pipe. This additional volume may be used to implement different types of silencers, e.g., a Helmholtz resonator or a $\lambda/4$ resonator or a reflecting chamber. This volume can preferably be used to suppress relatively low frequencies or frequency ranges.

It is self-evident that the features mentioned above and those explained below may be used not only in the specific combination given here but also alone or in any other combination without going beyond the scope of the present invention.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE INVENTION

Figure 1:
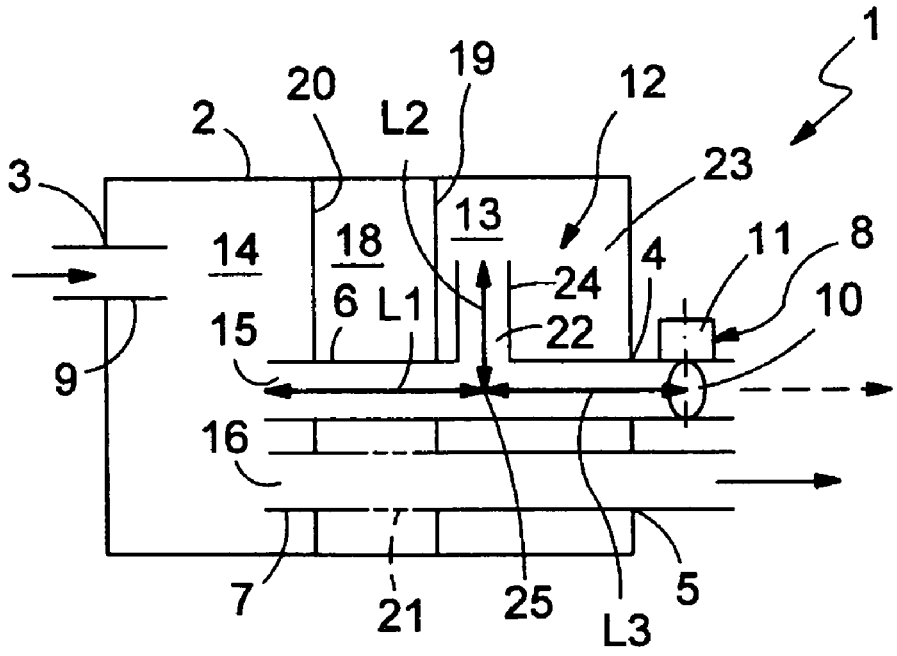
FIG. 1 illustrates a simplified basic diagram of an embodiment of a muffler in schematic form.

It is to be understood that the figures and descriptions of the present invention have been simplified to illustrate elements that are relevant for a clear understanding of the present invention, while eliminating, for purposes of clarity, many other elements found in typical mufflers. However, because such elements are well known in the art, and because they do not facilitate a better understanding of the present invention, a discussion of such elements is not provided herein. The disclosure herein is directed to all such variations and modifications known to those skilled in the art.

In accordance with FIGS. 1 through 6, muffler 1 comprises a housing 2 having at least one exhaust inlet and at least one exhaust outlet. In the illustrated embodiment(s), housing 2 has one exhaust inlet 3 and two exhaust outlets 4, 5. Muffler 1 is provided for installation in an exhaust gas system (not shown) of an internal combustion engine (also not shown), the internal combustion engine preferably being arranged in a motor vehicle. The housing 2 is equipped with at least two pipes. The at least two pipes may be arranged on the inlet end or the outlet end of the housing 2. In the exemplary embodiments illustrated herein, two pipes 6, 7 are provided, also being arranged on the outlet end as an example and, thus, each being allocated to one of the exhaust outlets 4, 5. However, another embodiment in which the two pipes 6, 7 are arranged at the inlet end is essentially also possible.

In the embodiments shown here, the two pipes 6, 7 lead separately out of the housing 2. It is essentially possible for the two pipes 6, 7 to be combined into a common pipe outside of the housing 2. In the case of pipes 6, 7 on the inlet end, they may branch off from a common pipe on the outside of the housing 2. It is likewise fundamentally possible for the two pipes 6, 7 to be combined into a common pipe on the outlet end or on the inlet end and/or to branch off from a common pipe inside the housing 2.

One of these two pipes 6, 7, namely the lower pipe 7, is permanently open. In contrast with that, the other pipe 6, namely the upper pipe 6 here, is designed to be controllable or switchable. To this end, a control device 8 is provided, with the help of which the controllable pipe 6 can be opened and closed, i.e., can be switched at least between an open state and a closed state. In the closed state of the switchable pipe 6, the exhaust gases flow exclusively through the permanently open pipe 7 during operation of the muffler 1. Accordingly, the exhaust gases flow into the housing 2 through the exhaust inlet 3 via an inlet pipe 9, for example, and flow out of the housing 2 through the respective exhaust outlet 5 via the permanently open pipe 7. The exhaust flow here is represented by arrows drawn with a solid line. In the open state of the switchable pipe 6, the exhaust may additionally flow through the respective exhaust outlet 4 via the switchable pipe 6 and out of the housing 2, which is represented by an arrow drawn with an interrupted line.

The control device 8 may have a valve 10, for example, which is situated in the switchable pipe 6 and cooperates with a drive 11. The control device 8 may be situated outside of the housing 2 as in the embodiments according to FIGS. 1 and 3 through 6. Likewise, the control device 8 may be arranged inside the housing 2, as in the embodiment according to FIG. 2. The control device 8 may operate passively or actively. The passive control device 8 controls the controllable pipe 6 preferably as a function of the prevailing exhaust gas pressure. The drive 11 may be formed by a restoring spring, for example, which preloads the valve 10 into its closed position. If there is a sufficient exhaust gas pressure, the valve 10 is pressurized and thus the controllable pipe 6 is opened. In contrast with that, an active control device 8 can control the controllable pipe 6 as a function of the operating parameters of the internal combustion engine, in particular as a function of the rotational speed and/or load of the internal combustion engine. For example, the control device 8 closes the controllable pipe 6 at a low load and/or in a low rotational speed range. At a higher load and/or in a larger rotational speed range, the controllable pipe 6 is then opened.

According to this invention, the switchable pipe 6 is acoustically coupled to a silencer system 12. This silencer system 12 is designed so that it is active with both a closed switchable pipe 6 as well as an opened switchable pipe 6 but its switching characteristics depend on the switch state of the switchable pipe 6. This means that when the switchable pipe 6 is opened, the silencer system 12 has different damping characteristics than when the switchable pipe 6 is closed. The different damping characteristics are characterized by damping of different frequencies and/or frequency ranges. The silencer system 12 thus dampens other frequencies and/or frequency ranges when the switchable pipe 6 is closed in comparison with the condition when the switchable pipe 6 is opened. A design of the silencer system 12 in which the silencer system 12 dampens interfering frequencies and/or interfering frequency ranges which occur in switching the switchable pipe 6, i.e., due to the altered flow through the muffler 1 in a targeted manner is especially advantageous. With appropriate coordination, it is possible to smooth out the transition in noise emission when switching the switchable pipe 6, so a sudden change in noise is prevented or at least greatly attenuated.

The housing 2 contains a first chamber 13 through which the two pipes 6, 7 pass. In addition, a second chamber 14 is provided in the housing 2, the two pipes 6, 7 having their open ends 15, 16 in this second chamber. Furthermore, the second chamber 14 communicates with the exhaust inlet 3.

Figure 2:
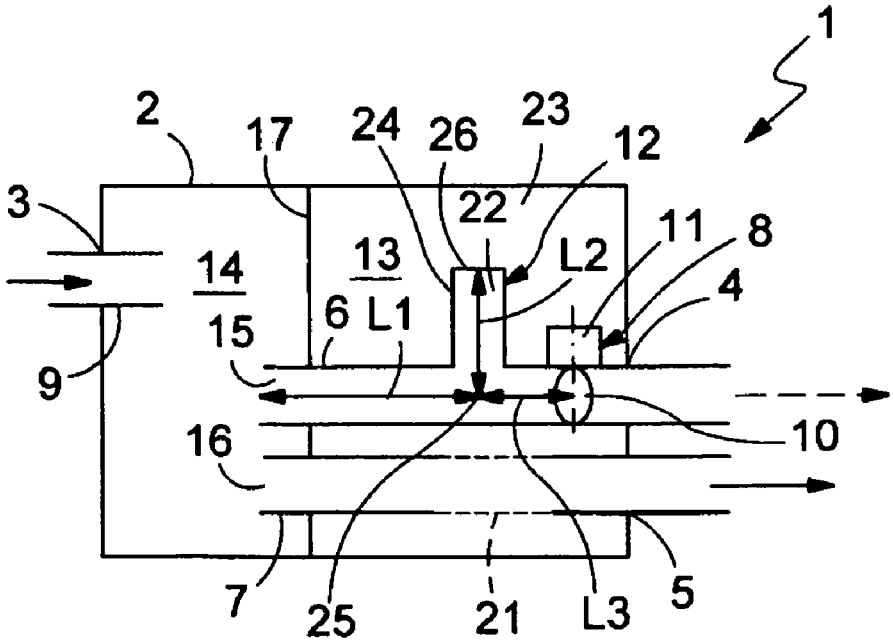
FIG. 2 illustrates a simplified basic diagram of another embodiment of the muffler in schematic form.

In the embodiment according to FIG. 2, only these two chambers 13, 14 are provided; they are separated from one another by a partition 17, especially an airtight partition. In contrast with that, in the embodiments in FIGS. 1 and 3 through 6, a third chamber 18 is also provided, this chamber being arranged between the two other chambers 13, 14 so that the two pipes 6, 7 also pass through it. The third chamber 18 is separated from the first chamber 13 by a partition 19, in particular an airtight partition. In addition, the third chamber 18 is separated from the second chamber 14 by a partition 20, in particular an airtight partition. The permanently open pipe 7 is acoustically coupled to the third chamber 18. Acoustic coupling is implemented here by means of a perforation 21 in the wall of the permanently open pipe 7 within the third chamber 18, for example. The third chamber 18 here serves as a reflecting chamber and may optionally be filled with a suitable silencer material. In another embodiment, instead of a perforation 21, an opening may also be provided in the wall or an interruption may be provided in the permanently open pipe 7 to form the resonator silencer. In addition, the third chamber 18 may also serve as a resonant volume for a Helmholtz resonator; the permanently open pipe 7 is then equipped with a corresponding branching pipe.

According to FIGS. 1 through 6, the silencer system 12 has a volume 22 and/or 23, which is acoustically coupled to the switchable pipe 6. This volume 22, 23 is added to the volume of the switchable pipe 6 and used to achieve the desired silencing effect.

In the embodiment illustrated in FIG. 1, the volume of the silencer system 12 includes a pipe volume 22 of a branching pipe 24 and a chamber volume 23 of the first chamber 13. The branching pipe 24 branches away from the switchable pipe 6 in such a way that it opens inside the first chamber 13. The branching pipe 24 communicates with the switchable pipe 6 on the one hand and with the first chamber 13 on the other hand. In this embodiment, when the switchable pipe 6 is closed, the silencer system 12 comprises a Helmholtz resonator whose resonance chamber is formed by the first chamber 13 and whose resonator throat is formed by the branching pipe 24 and the section of the switchable pipe 6 extending from the open end 15 to a branching point 25. The silencing effect of a Helmholtz resonator results from the volume of the resonance chamber on the one hand and from the volume of the resonator throat on the other hand. The volume of the resonator throat is determined in turn by the length of the throat and the cross section of the throat. The throat length, which is effective when the switchable pipe 6 is closed, is represented in simplified terms here by double arrows, namely by an arrow L1 representing the length of the section of the controllable pipe 6 from the open end 15 to the branching point 25 as well as an arrow L2 representing the length of the branching pipe 24. The active throat length when the switchable pipe 6 is closed is thus the sum of the two individual throat lengths L1+L2.

In addition, when the switchable pipe 6 is closed, a $\lambda/4$ resonator is formed in the pipe, its resonator length extending from the open end 15 of the switchable pipe 6 to the closure of the switchable pipe 6, i.e., as far as the valve 10. This resonator length thus corresponds to the sum of the two individual throat lengths L1+L3, where L3 is the distance between the branching point 25 and the closure, i.e., the valve 10. The silencer system 12 thus additionally includes said λ/4 resonator when the switchable pipe 6 is closed.

When the switchable pipe 6 is open, however, only the length L2 of the branching pipe 24 is active, so the resonant response of the Helmholtz resonator changes significantly, namely in the direction of higher frequencies. In addition, when the switchable pipe 6 is open, the aforementioned λ/4 resonator is inactive.

The embodiment shown in FIG. 2 differs from the embodiment shown in FIG. 1 initially in that the branching pipe 24 is sealed by a plate 26 on its remote end from the switchable pipe 6. However, the silencer system 12 can no longer form a Helmholtz resonator as a result of this measure; instead, a λ/4 resonator is formed in this embodiment. With the switchable pipe 6 closed, the effective length of the λ/4 resonator is defined by the pipe length from the open end 15 of the switchable pipe 6 to the bottom 26, i.e., by the total of the lengths L1+L2. In contrast with that, the effective length of the λ/4 resonator is reduced to the length L2 of the branching pipe 24 when the switchable pipe 6 is opened. Here again, the silencing effect is shifted in the direction of higher frequencies. Furthermore, with the switchable pipe 6 closed, the additional λ/4 resonator comes into play here, its resonator length being determined by the distance of the open end 15 from the valve 10, i.e., by the sum of the lengths L1+L3. When the switchable pipe 6 is opened, this additional λ/4 resonator is eliminated. Thus the silencer system 12 in this embodiment essentially encompasses two λ/4 resonators, one of which is active only when the switchable pipe 6 is closed, while the other is active even when the switchable pipe 6 is opened but then has a shorter resonator length.

In this embodiment, it is also optionally possible for the branch pipe 24 and/or the bottom 26 to be provided with a leak, so there is essentially a communicating connection between the switchable pipe 6 and the first chamber 13. As a result of this leak, the bandwidth of the silencing effect of the λ/4 resonator can be increased.

In the embodiment illustrated in FIG. 2, the volume of the silencer system 12 is thus formed exclusively by the pipe volume 22 of the branching pipe 24. The chamber volume 23 may be omitted for the silencer system 12 of the switchable pipe 6 and can be utilized as an example of the resonator silencer assigned to the permanently open pipe 7. Accordingly, in this embodiment, the permanently open pipe 7 communicates through its perforation 21 with the first chamber 13. The first chamber 13 in this embodiment may optionally be filled with suitable silencer material. In another embodiment, instead of the perforation 21 an opening may also be provided in the wall or an interruption in the permanently open pipe 7 to design the resonator silencer. In addition the first chamber 13 may then also serve as a resonant volume for a Helmholtz resonator; then the permanently open pipe 7 is equipped with a corresponding branching pipe.

Figure 3:
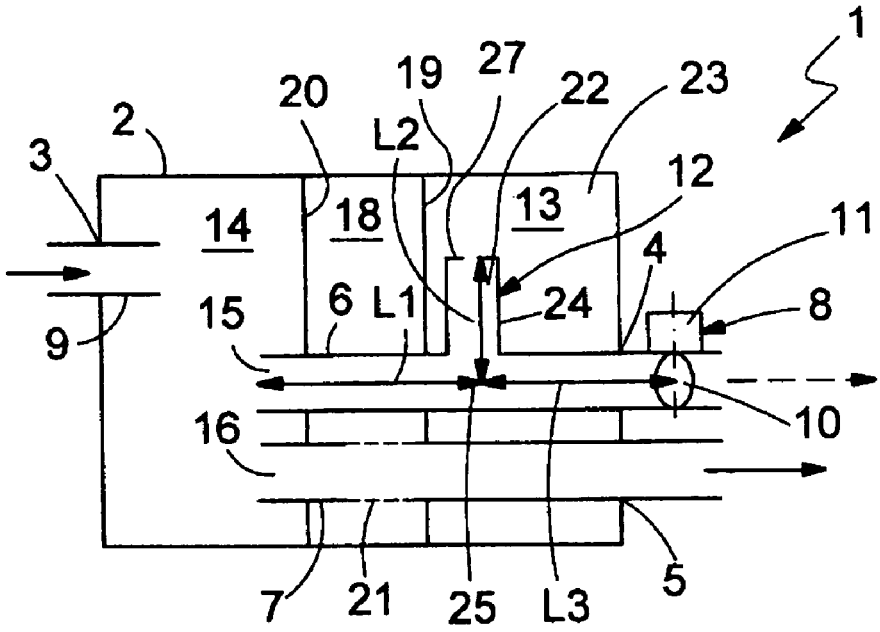
FIG. 3 illustrates a simplified basic diagram of another embodiment of the muffler in schematic form.

In the embodiment illustrated in FIG. 3, the branching pipe 24 is provided with a perforated orifice 27 on its remote end from the switchable pipe 6. This results in a λ/4 resonator for the silencer system 12 having a relatively broadband silencing effect. At the same time, the chamber volume 23 may fundamentally serve as a resonant volume for a Helmholtz resonator. When the switchable pipe 6 is closed, the effective length of the λ/4 resonator is given by the sum of the individual lengths L1+L2 and for the Helmholtz resonator by the sum of the individual lengths L1+L2. In addition, the other λ/4 resonator, whose resonator length is formed by the sum of individual lengths L1+L3, is also active here when the switchable pipe 6 is closed. When the switchable pipe 6 is opened, the active lengths are reduced, namely for the λ/4 resonator to the individual length L2 and for the Helmholtz resonator likewise to the individual length L2. At the same time, the other λ/4 resonator is deactivated when the switchable pipe 6 is opened. In this embodiment the volume of the silencer system 12 is formed by the pipe volume 22 as well as by the chamber volume 23.

It is clear that two or more such branching pipes 24 may also be provided with or without a bottom 26 and/or a perforated plate 27, these pipes differing from one another in particular through different pipe cross sections and/or pipe lengths and communicating in particular with the same or different chambers.

Figure 4:
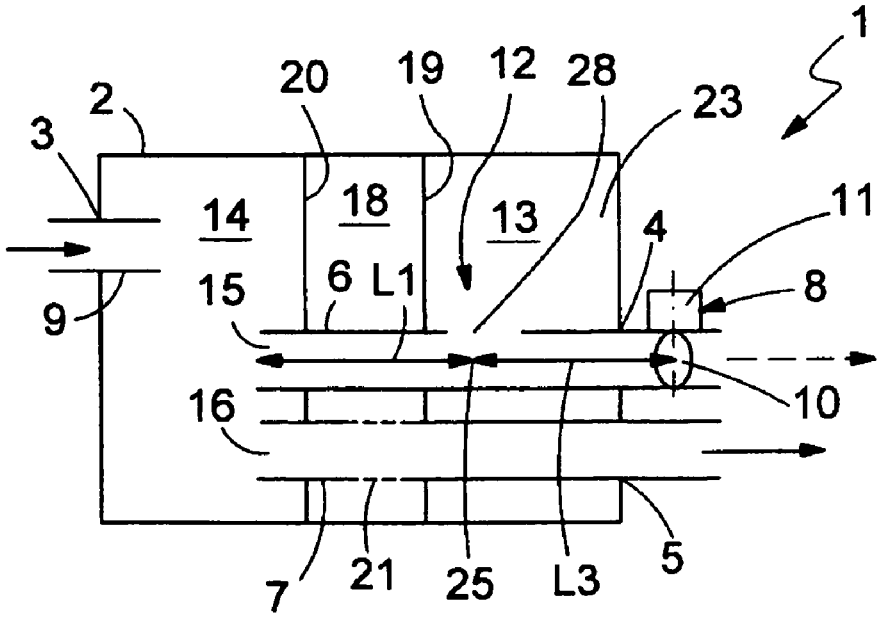
FIG. 4 illustrates a simplified basic diagram of another embodiment of the muffler in schematic form.
Figure 5:
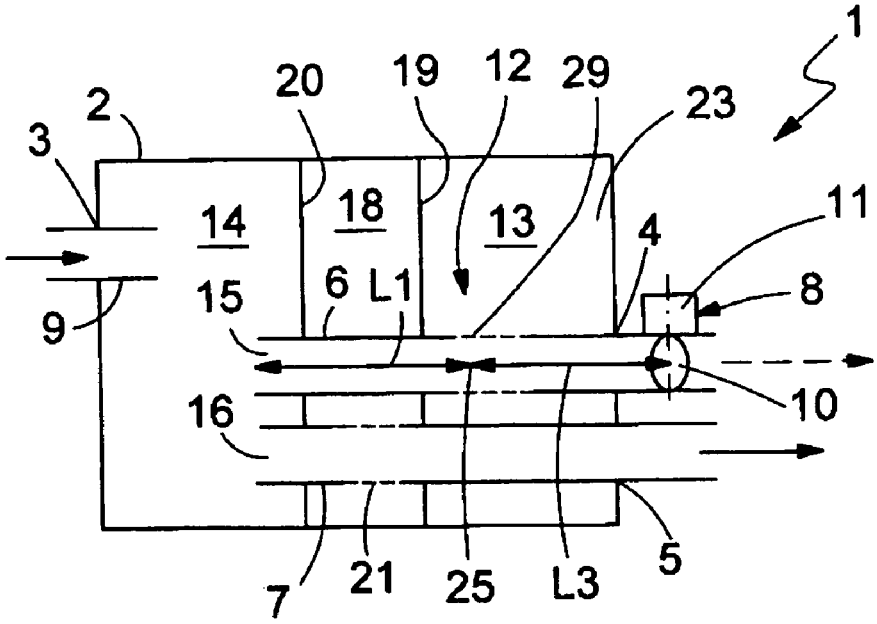
FIG. 5 illustrates a simplified basic diagram of another embodiment of the muffler in schematic form.
Figure 6:
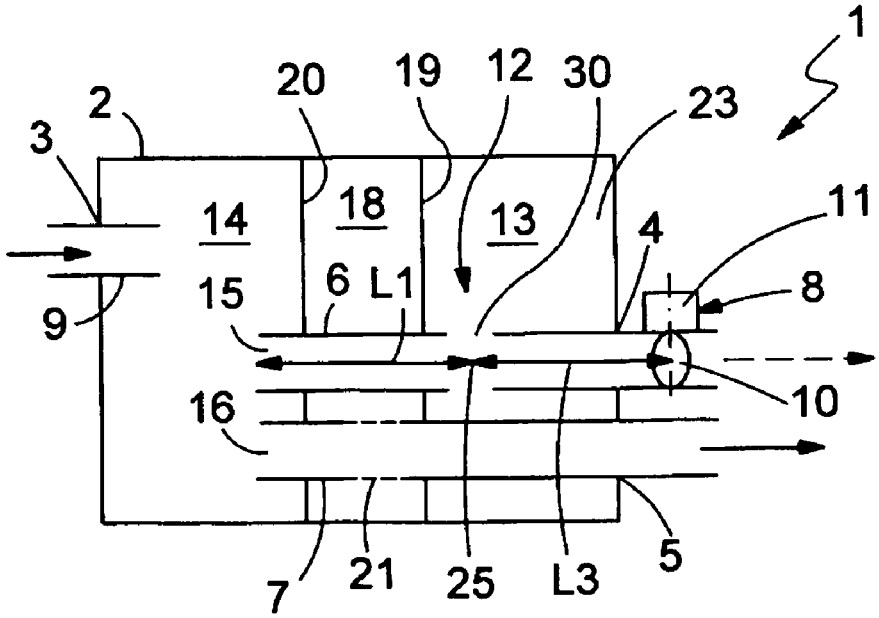
FIG. 6 illustrates a simplified basic diagram of another embodiment of the muffler in schematic form.

In the embodiments in FIGS. 4 through 6, the volume of the silencer system 12 includes only the chamber volume 23 of the first chamber 13. Neither a branching pipe 24 nor a pipe volume 22 is provided in these embodiments. Nevertheless, the switchable pipe 6 communicates with the first chamber 13. To do so, the switchable pipe 6 in the embodiment according to FIG. 4 has an opening 28 and in the embodiment according to FIG. 5 has a perforation 29 and in the embodiment according to FIG. 6 has an interruption 30. This yields a Helmholtz resonator for the closed state of the switchable pipe 6 such that the throat length of the resonator is formed by the individual length L1, i.e., by the section of the switchable pipe 6 extending from the open end 15 to the "branching point" 25. The branching point 25 here corresponds to the point at which there is communication between the first chamber 13 and the switchable pipe 6 and can also be referred to as the connecting point 25.

In addition, in the closed state of the switchable pipe 6, essentially the λ/4 resonators whose effective length is determined by the sum of individual lengths L1+L3 can also be active here.

In the open state of the switchable pipe 6, the throat length of the Helmholtz resonator is reduced to approximately a value of zero. Subsequently then there is a reflecting chamber which has different damping characteristics than the Helmholtz resonator.

It is noteworthy that in all embodiments the branching point 25 and/or the connecting point 25 between the switchable pipe 6 and the first chamber 13 and/or the branching pipe 24 is situated a distance away from the open end 15 of the switchable pipe 6. Furthermore, said connecting point 25 is arranged between the open end 15 and the final controlling element, i.e., the valve 10 of the control device 8 in this case. This ensures that the sound to be dampened will in any case reach the additional volume 22, 23 of the silencer system 12.

The Helmholtz resonators described here and the λ/4 resonators described as well as combinations of a Helmholtz resonator and a λ/4 resonator have in common the fact that during operation, exhaust gases of the exhaust flow pass through them. These resonators are thus bypass resonators. In contrast with that there are the resonators that work with a reflecting chamber, arranged in the series connection, i.e., so that the exhaust gases of the exhaust gas flow can pass through it during operation.

In the embodiments according to FIGS. 1 through 3, the silencer system 12 is designed so that it has at least one such bypass reactor when the switchable pipe 6 is closed as well as when it is opened. The embodiment according to FIG. 1 has a Helmholtz resonator, the embodiment according to FIG. 2 has a λ/4 resonator and the embodiment according to FIG. 3 has a combination of a Helmholtz resonator and a λ/4 resonator. Due to the opening and/or closing of the switchable pipe 6, the respective bypass resonator remains active but its damping characteristic changes.

In contrast with that, the silencer system 12 in the embodiments according to FIGS. 4 through 6 essentially also has at least one bypass resonator, but it is active only when the switchable pipe 6 is closed. When the switchable pipe 6 is opened, the resonance chamber of the respective Helmholtz resonator is converted to a reflecting chamber. The resonator silencer, which works with it has gases flowing through it, i.e., it is arranged in the main path. To this extent, in these embodiments the damping principle is altered by the switching operation of the switchable pipe 6, whereas in the embodiments according to FIGS. 1 through 3 the damping principle remains the same in both switch states of the switchable pipe 6.

It is clear that the configurations and arrangements of the chambers 13, 14, 18 and the pipes 6, 7, 9 shown here are essentially given only as examples, so that other configurations and arrangements are also possible. For example, the two pipes 6 and 7 need not have their free ends 15, 16 in the same chamber; the inlet pipe 9 need not open into the same chamber as the other pipes 6, 7. For example, the intake pipe 9 may open into the middle chamber 18 in which case the respective partition 20 is designed to be gas-permeable. It is also possible for the permanently open pipe 7 to have its open end 16 in the middle chamber 18, for example, whereby the permanently open pipe 7 may pass through the second chamber 14 to achieve an especially great pipe length.

It will be apparent to those skilled in the art that modifications and variations may be made in the apparatus and process of the present invention without departing from the spirit or scope of the invention. It is intended that the present invention cover the modification and variations of this invention provided they come within the scope of the appended claims and their equivalents.

What is claimed is:

1. A muffler for an exhaust gas system of an internal combustion engine comprising:

a housing having at least one exhaust inlet and at least one exhaust outlet;

a control device;

a silencer system;

a first and a second pipe on said exhaust inlet or outlet ends, said first pipe being switchable at least between an open state and a closed state by said control device, and being acoustically coupled to said silencer system such that said silencer system is active when said first pipe is opened as well as when said first pipe is closed, said silencer system having a different damping characteristic when said first pipe is opened than when it is closed, wherein at least one of said first and second pipes is permanently open, and wherein said housing is partitioned into a first, second and a third chamber, said third chamber being between said first and second chambers, and said at least one permanently open pipe passes through said third chamber and is acoustically coupled to said third chamber.

2. The muffler according to claim 1, wherein said silencer system has a volume that is acoustically coupled to said first switchable pipe.

3. The muffler according to claim 2, wherein said volume comprises at least one pipe volume of at least one branching pipe that branches off from and communicates with said first switchable pipe.

4. The muffler according to claim 2, wherein said volume comprises a chamber volume of a first chamber of said housing through which said first switchable pipe passes, said chamber volume communicating with the said first switchable pipe.

5. A muffler for an exhaust gas system of an internal combustion engine comprising:

a housing having at least one exhaust inlet and at least one exhaust outlet;

a control device;

a silencer system;

a first and a second pipe on said exhaust inlet or outlet ends, said first pipe being switchable at least between an open state and a closed state by said control device, and being acoustically coupled to said silencer system such that said silencer system is active when said first pipe is opened as well as when said first pipe is closed, said silencer system having a different damping characteristic when said first pipe is opened than when it is closed, wherein said silencer system has a volume that is acoustically coupled to said first switchable pipe, wherein said volume comprises at least one pipe volume of at least one branching pipe that branches off from and communicates with said first switchable pipe, wherein said branching pipe is sealed at its remote end from said first switchable pipe, said sealed branching pipe forming a lambda/4 resonator.

6. A muffler for an exhaust gas system of an internal combustion engine comprising:

a housing having at least one exhaust inlet and at least one exhaust outlet;

a control device;

a silencer system;

a first and a second pipe on said exhaust inlet or outlet ends, said first pipe being switchable at least between an open state and a closed state by said control device, and being acoustically coupled to said silencer system such that said silencer system is active when said first pipe is opened as well as when said first pipe is closed, said silencer system having a different damping characteristic when said first pipe is opened than when it is closed, wherein said silencer system has a volume that is acoustically coupled to said first switchable pipe, wherein said volume comprises at least one pipe volume of at least one branching pipe that branches off from and communicates with said first switchable pipe, wherein said branching pipe communicates with a first chamber of the housing through which said first switchable pipe passes, said branching pipe and said first chamber forming a Helmholtz resonator.

7. The muffler according to claim 3, wherein said branching pipe further comprises a perforated plate on an end, said end being remote from said first switchable pipe.

8. The muffler according to claim 4, wherein said first pipe has an opening or a perforation or an interruption in said first chamber, said first pipe communicating with said first chamber through said opening or said perforation or said interruption.

9. The muffler according to claim 3, wherein said first switchable pipe communicates with said branching pipe at a point between an open end of said first switchable pipe and said control device.

10. The muffler according to claim 3, wherein said first switchable pipe communicates with said first chamber at a point between an open end of said first switchable pipe and said control device.

11. The muffler according to claim 1, wherein said at least one permanently open pipe passes through said first chamber.

12. The muffler according to claim 1, wherein said first switchable pipe passes through said third chamber.

13. The muffler according to claim 1, wherein said third chamber is separated from said first chamber by a first partition and from said second chamber by a second partition.

14. The muffler according to claim 1, wherein said first and second pipes have their open ends in said second chamber of said housing.

15. The muffler according to claim 1, wherein said control device further comprises at least one valve arranged in said first switchable pipe.

16. The muffler according to claim 15, wherein said control device is situated inside said housing.

17. The muffler according to claim 15, wherein said control device is situated outside said housing.

18. The muffler according to claim 1, wherein said control device controls said first switchable pipe passively as a function of exhaust gas pressure.

19. The muffler according to claim 1, wherein said control device controls said first switchable pipe actively as a function of rotational speed of said internal combustion engine.

20. The muffler according to claim 1, wherein said control device controls said first switchable pipe actively as a function of load of said internal combustion engine.

21. The muffler according to claim 1, wherein said silencer system is adapted such that interfering frequencies are dampened, said interfering frequencies occurring while switching said first switchable pipe due to a change in the flow through the muffler.

22. The muffler according to claim 1, wherein said silencer system acts as a bypass resonator when said first switchable pipe is opened as well as when said switchable pipe is closed.

23. The muffler according to claim 22, wherein said bypass resonator is a Helmholtz resonator or a $\lambda/4$ resonator or a combination of a Helmholtz resonator and a $\lambda/4$ resonator when said first switchable pipe is opened as well as when said first switchable pipe is closed.

24. The muffler according to claim 1, wherein said first and second pipes branch off from a first common pipe inside or outside of said housing.

25. The muffler according to claim 1, wherein said first and second pipes are brought together to form a second common pipe inside or outside of said housing.

* * * * *